US005265953A

United States Patent [19]

Röck et al.

[11] Patent Number: 5,265,953

[45] Date of Patent: Nov. 30, 1993

[54] DRAWER

[75] Inventors: Erich Röck; Josef Brunner, both of Höchst; Klaus Brüstle, Lauterach, all of Austria

[73] Assignee: Julius Blum Gesellschaft m.b.H., Austria

[21] Appl. No.: 571,848

[22] Filed: Aug. 23, 1990

Related U.S. Application Data

[63] Continuation of Ser. No. 193,683, May 13, 1988, abandoned.

[30] Foreign Application Priority Data

May 22, 1987 [AT] Austria ..... 1312/87

[51] Int. Cl.[5] ..... A47B 88/00

[52] U.S. Cl. ..... 312/348.4; 312/330.1

[58] Field of Search ..... 312/330.1, 263, 348.2, 312/348.4; 403/407.1, 231, 245

[56] References Cited

U.S. PATENT DOCUMENTS

| | | | |
|---|---|---|---|
| 2,218,928 | 10/1940 | Towler et al. . | |
| 2,427,294 | 9/1947 | McNabb . | |
| 2,704,331 | 3/1955 | Stott et al. . | |
| 2,739,492 | 3/1956 | Lux . | |
| 2,999,267 | 9/1961 | Sterling et al. . | |
| 3,121,339 | 2/1964 | Minno et al. . | |
| 4,002,261 | 1/1977 | Litchfield . | |
| 4,025,216 | 5/1977 | Hiyes . | |
| 4,108,520 | 8/1978 | Litchfield | 312/330 R |
| 4,128,284 | 12/1978 | King | 312/263 |
| 4,279,455 | 7/1981 | Santo | 312/263 |
| 4,411,164 | 10/1983 | Durenec et al. . | |
| 4,458,965 | 7/1984 | Ohlendorf et al. | 312/330 R |
| 4,459,945 | 7/1984 | Chatfield . | |
| 4,553,873 | 11/1985 | Salice | 403/245 |
| 4,557,531 | 12/1985 | Rock et al. | 312/341 R |
| 4,642,839 | 2/1987 | Urban . | |
| 4,664,548 | 5/1987 | Brinkmann | 403/407.1 |
| 4,700,994 | 10/1987 | Rock et al. | 312/330 R |
| 4,705,252 | 11/1987 | Goers . | |
| 4,846,538 | 7/1989 | Rock et al. | 312/330.1 |
| 4,850,659 | 7/1989 | Rock et al. | 312/330.1 |

FOREIGN PATENT DOCUMENTS

| | | | |
|---|---|---|---|
| 0267477 | 5/1988 | European Pat. Off. | 312/330 R |
| 3120181 | 12/1982 | Fed. Rep. of Germany . | |
| 3416627 | 11/1985 | Fed. Rep. of Germany | 312/330 R |
| 3620450 | 1/1987 | Fed. Rep. of Germany . | |
| 2000436 | 1/1979 | United Kingdom | 312/330 R |

*Primary Examiner*—James R. Brittain
*Assistant Examiner*—Brian K. Green
*Attorney, Agent, or Firm*—Wenderoth, Lind & Ponack

[57] ABSTRACT

A drawer includes two parallel metal drawer side walls, each being provided with a side wall rail for a runner roller of a pull-out guide. A front wall is releaseably connectable to the drawer side walls and lies in a mounted position between the drawer side walls. A connecting fitting member is premounted to the front wall for each drawer side wall. The fitting member has a stop which lies laterally beside the front wall and is pullable towards the front side of the respective drawer side wall to obtain a firm connection between the front wall and the drawer side wall.

50 Claims, 7 Drawing Sheets

DRAWER

This application is a continuation of now abandoned application, Ser. No. 07/193,683, filed May 13, 1988.

FIELD AND BACKGROUND OF THE INVENTION

The invention relates to a drawer including two parallel drawer side walls, in particular of metal, each drawer side wall being provided with a side wall rail for a runner roller of a pull-out guide, and a front wall which is releaseably connectable to the drawer side walls and which extends in the mounted position between the drawer side walls.

With regard to the position of front plates or front walls of drawers with respect to side walls of the drawers, substantially two different structural arrangements are known. In the first type, the front plate extends at least over the full drawer width and in the mounted position abuts the front sides of the drawer side walls. For fast mounting of the front plate to the drawer side walls, a number of quick connector devices are known with this type of drawer. In such case, the front plate is provided with premounted fitting members, is fitted onto the otherwise finished drawer from the front, and then is pulled towards the front sides of the drawer side walls by means of connecting devices, for example clamping eccentrics, the rear side of the front plate serving as a stop abutting the front sides of the drawer side walls.

In the second type of drawer, the front wall lies in the mounted position between the drawer side walls. Drawers of this kind are generally used as so-called internal drawers, where a front member, for example the door of a cupboard, is arranged in front of the drawer front wall and covers in the closed position one or several drawer front walls. For connecting such a front wall with drawer side walls, it is conventional to provide specially formed drawer side walls with inwardly projecting fastening angle members to which the front wall is then attached, e.g. by screws, from the inside. The operation of assembling such drawers is relatively time-consuming. Moreover, there is the risk that the loose fastening screws which are necessary for assembling the drawer may become lost. A further disadvantage is the fact that it is necessary to provide special drawer side wall constructions with fastening angles that are suitable exclusively for use with a front wall that extends between the drawer side walls.

SUMMARY OF THE INVENTION

It is the object of the invention to provide a drawer of the afore-mentioned type in which the front wall, which lies in the mounted condition between the drawer side walls, is easily, quickly and at the same time securely fastenable to the drawer side walls. In should further be possible to use for this drawer the same drawer side walls that are used with a drawer in which the front plate abuts in the mounted condition with the front sides of the drawer side walls.

According to the invention these objects are achieved in that for each drawer side wall there is provided one connecting fitting including a fitting member which is premounted at the front wall and has at least one stop which lies substantially laterally beside the front wall and is pullable towards the front side of the respective drawer side wall to obtain a firm connection between the front wall and the drawer side wall. By means of the stop which is formed in the premounted fitting member laterally beside the front wall, and due to the possibility of pulling such stop toward the front side of the respective drawer side wall in various ways, a quick and firm connection between the front wall and each drawer side walls is possible with a drawer in which the front wall lies between the drawer side walls, even though in such arrangement the front wall itself cannot serve as a front side stop. Possible tolerances can be compensated for with this type of connection. In general, the stop advantageously will be positioned essentially laterally beside the front face of the front wall because then the front face of the front wall will be positioned substantially flush with the front side of the respective drawer side wall.

The use of the connecting fitting according to the invention further provides the possibility of using the same drawer side walls both for such an internal drawer as well as for conventional a drawer wherein the front plate extends over the front sides of the drawer side walls. Advantages with respect to storage and manufacture are thus provided, since in the largely automized furniture production industry, wherein even the holes for fastening the body rails associated with the drawer side walls are predrilled, no differences need be made between internal drawers and the other type drawers, except for the front plate and its fittings (a slightly shorter bottom may be necessary with an internal drawer).

To facilitate mounting of the front wall to an otherwise finished drawer by means of a connecting fitting according to the invention, a preferred embodiment of the invention provides that the fitting member which is connected with the front wall is fittable onto or insertable into the associated drawer side wall from the front side of the drawer side wall essentially in the longitudinal direction of the drawer side wall. The fitting member then being nondisplaceably connected with the drawer side wall by means of a connecting device or member, and the stop of the fitting member is pulled towards the front side of the drawer side wall. In this arrangement, it is particularly favorable for quick mounting that both fitting members, i.e. connected to the front wall at the right and at the left ends thereof, simultaneously are moved into connecting position with the respective drawer side walls.

Particularly with hollow profiled-aluminum drawer side walls, it is advantageous according to a preferred feature of the invention to provide the fitting member premounted to the front wall with at least one projection which has at least one nose or protrusion extending laterally therefrom. The projection extends essentially at a right angle to the front wall and is insertable into the drawer side wall from the front side thereof. A spring tongue, which is pullable in the longitudinal direction of the drawer side wall by means of a clamping eccentric provided in the drawer side wall, engages behind the nose(s) of the projection of the fitting member and pulls the fitting member into the drawer side wall. For mounting the front wall, the latter is, together with the fitting members which are premounted thereon, pushed into the drawer side walls until the spring tongues engage behind the noses of the projections of the fitting members. Then the spring tongues together with the fitting members can be moved inwardly by means of the clamping eccentrics until the stops abut snugly at the front sides of the respective drawer side walls.

Particularly with a drawer side wall of steel, which generally has a Z-shaped profile, it advantageously may be provided that the fitting member premounted to the front wall has a vertical holding surface which extends substantially transversely to the front wall. The connecting device is substantially a clamping plate which is, through an opening or recess in the vertical flange of a drawer side wall. screwable to the fitting member the holding surface of which abuts the other side of the flange. An inclined surface formed on the clamping plate abuts the drawer side wall and thus exerts a force on the clamping plate and the fitting member which acts substantially in the longitudinal direction of the drawer side wall. To avoid the use of separate fitting members which might be lost, it may be provided that the clamping plate is, before the front wall is fitted between the drawer side walls, loosely held at the fitting member by means of the screw which is provided for screwing the clamping plate and the fitting member together.

A simple and secure connection between the premounted fitting member and the front wall is according to a preferred embodiment wherein the fitting member has a groove which extends, in the mounted position, transversely to the longitudinal direction of the drawer side walls and receives the front wall, the front wall being preferably screwable to such recess. The front wall in this arrangement may be a simple plate which need not be provided with the type of recesses that receive fitting members and that usually are provided on fittings. Holes for a screwing connection may be predrilled.

BRIEF DESCRIPTION OF THE DRAWINGS

In the following the invention will be described in more detail with reference to the accompanying drawings, in which.

DESCRIPTION OF THE PREFERRED EMBODIMENTS

Figure 1:
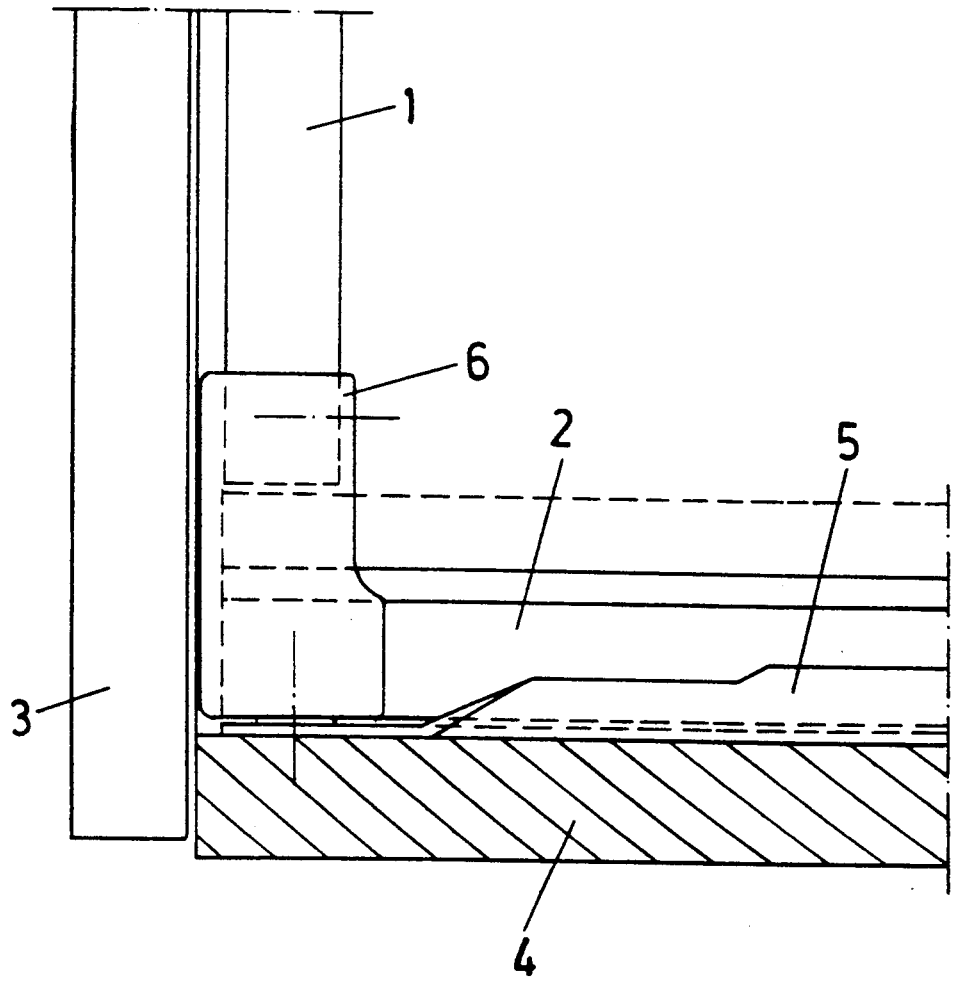
FIG. 1 is a schematic top view of a part of a drawer according to the invention used as an internal drawer.

FIG. 1 shows an internal drawer in which a separate front element 3, for example the door of a cupboard, is provided in front of a front wall 1 of the drawer (bottom not shown) having side walls 2. The drawer is forwardly extractable on a body rail 5 which is fixed to a body 4 of the cupboard, when the front element 3 is opened. A connecting fitting 6 is provided by means of which the front region of the drawer side wall 2 is laterally connectable in a quick and easy manner with the front plate 1 which lies in the mounted condition between the two side walls of the drawer. The drawer side wall which is parallel to the illustrated drawer side wall 2 and forms the other side wall of the drawer is not shown in FIG. 1. FIG. 1 is a general or schematic view which shows the arrangement in an internal drawer but does not illustrate the essential features of the invention.

Figure 2:
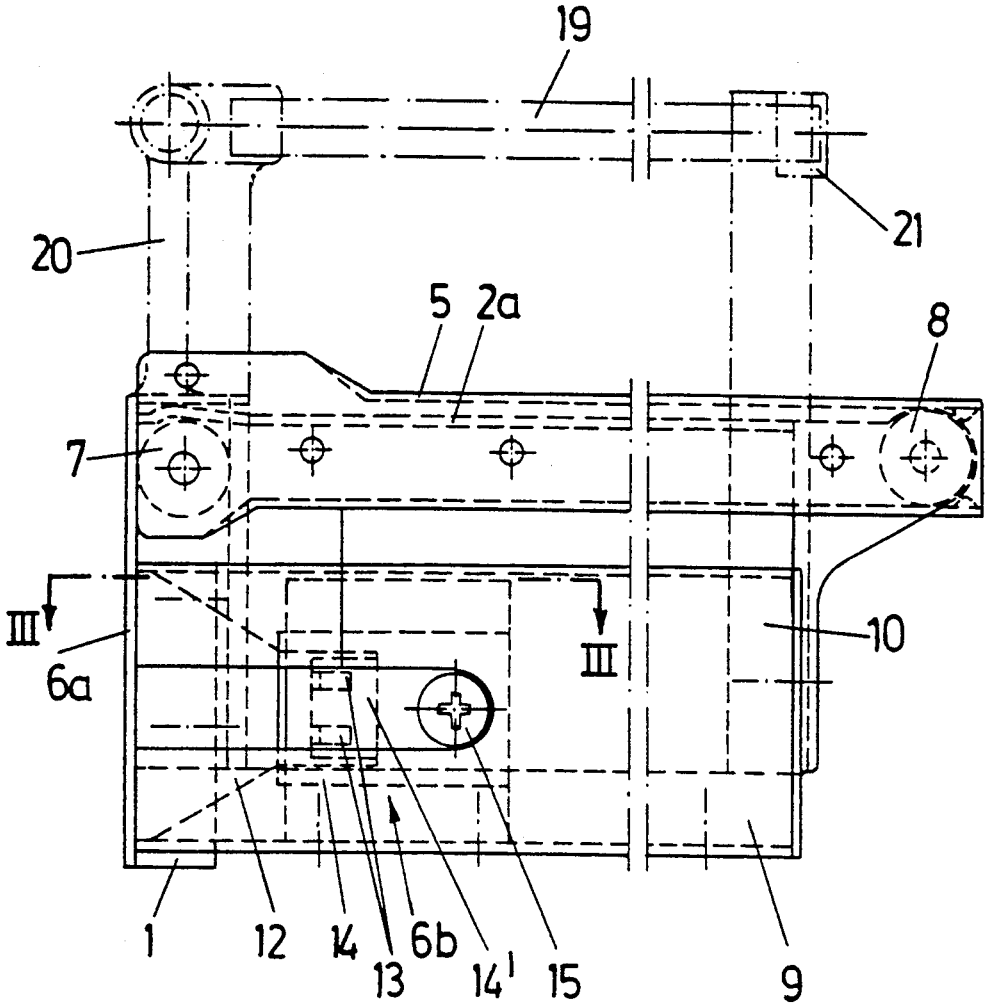
FIG. 2 is a side view of an embodiment of the drawer according to the invention with a hollow profiled-aluminum side wall.
Figure 3:
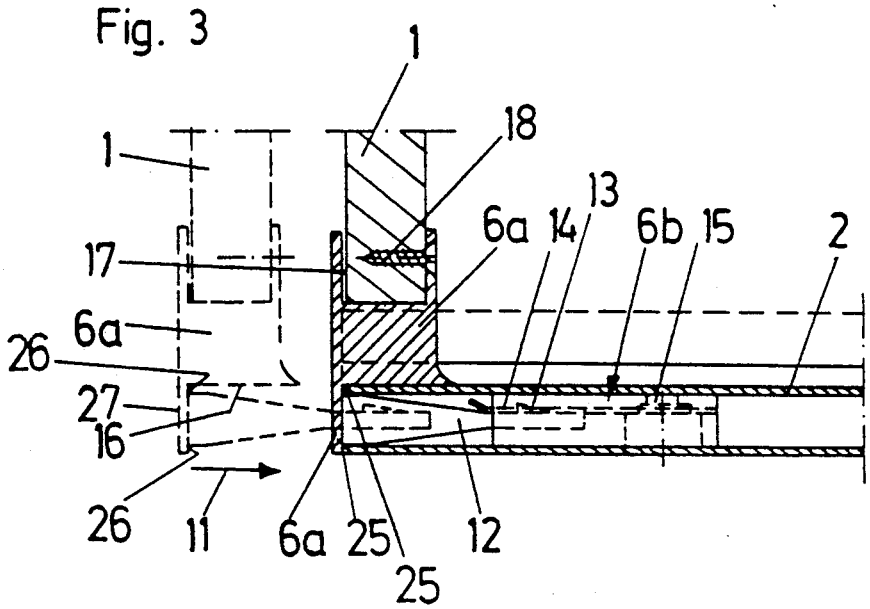
FIG. 3 is a sectional view along line III—III of FIG. 2.
Figure 4:
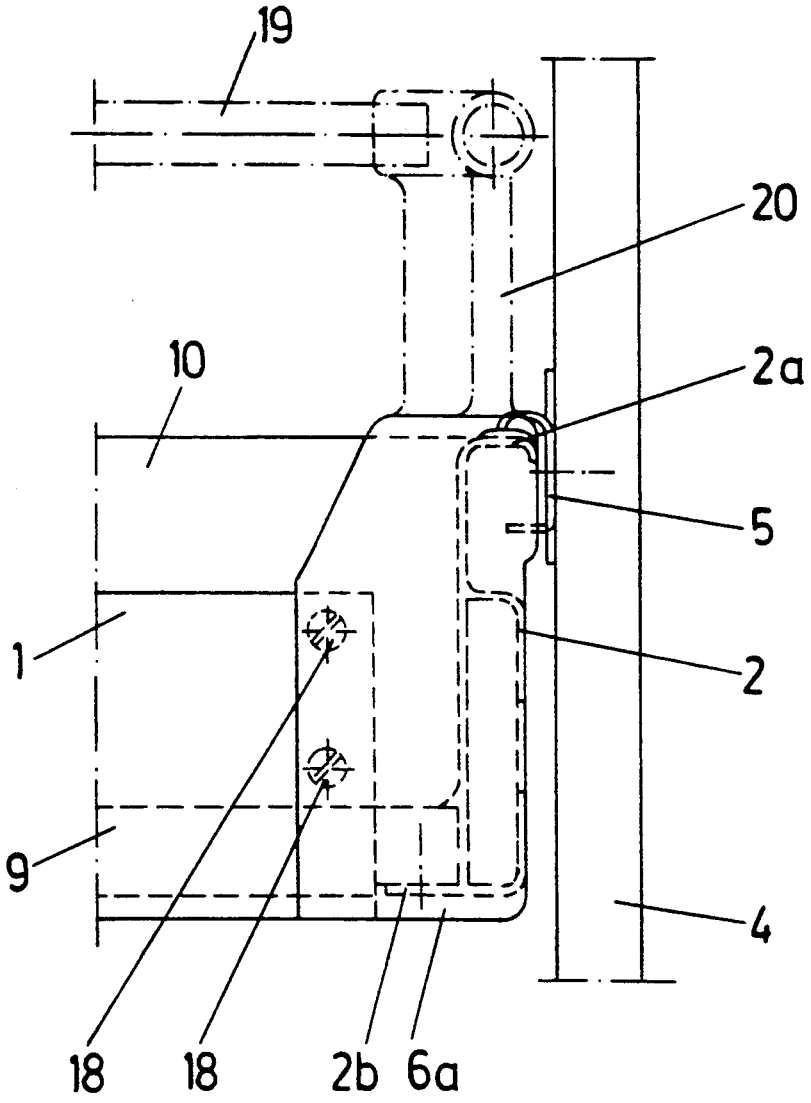
FIG. 4 is a front view of a part of the embodiment shown in FIGS. 2 and 3.

In the embodiment illustrated in FIGS. 2 to 4, the drawer side wall is a hollow profiled-aluminum side wall 2 on the upper side of which is formed a side wall rail **2*a* for a runner roller 7 mounted at the body 4. A runner roller 8 mounted at the drawer side wall 2 and an associated body rail 5 form with roller 7 a simple pull-out guide assembly. The drawer further comprises a bottom 9 which is supported by a leg 2*b* of the drawer side wall 2 and which is not shown in detail in FIG. 3, a rear wall 10 and a front wall 1 which can be releaseably connected with the drawer side wall 2** in a manner which will be described in more detail in the following.

For releaseably connecting the front wall 1 with the drawer side wall 2, the present embodiment comprises a substantially two-part connecting fitting **6*a*, 6*b*. One part is formed by fitting member 6*a* which is premountable with the front plate 1 and is insertable from the front side of the drawer side wall 2 into the drawer side wall 2 by being moved in the longitudinal direction of the drawer side wall (arrow 11, FIG. 3). A connecting member of the connecting fitting is generally indicated by numeral 6*b* and is arranged in the drawer side wall 2. Connecting member 6*b* is adapted to pull the fitting member 6*a* towards the front side or end 25 of the drawer side wall 2, whereat stops 26 disposed beside the front wall 1 snugly abut front side 25 and thus guarantee between the side wall and the front plate a firm connection which is free of clearance or play. In more detail, the fitting member 6*a* comprises a projection 12 with two laterally extending noses or protrusions 13. When the projection 12 is inserted, the noses 13 press a plate spring or spring tongue 14 of connecting member 6*b* to the side. Thereafter the noses 13 enter into an opening 14' in the spring tongue 14, and the latter snaps behind the noses 13 and onto the projection 12. Thus, the fitting member 6*a* and the front wall 1 are provisionally connected with the drawer side wall 2. By actuating a clamping eccentric 15, for example by means of a screw driver, the spring tongue 14 is moved inwardly and thereby catches the noses 13, behind which it engages, and thus pulls the complete fitting member 6*a* firmly toward the end of the drawer side wall 2**.

For releasing the connection between the fitting member **6*a* and drawer side wall 2, first the clamping eccentric 15 is released and then the spring tongue 14 is lifted (for example by means of a screw driver through an opening in the external wall of the drawer side wall) so that the noses 13** can be moved outwardly.

To obtain a definitely stable connection between the fitting member **6*a* and the drawer side wall 2, the fitting member has an abutting surface 16 which is directed towards the inner side surface of the drawer side wall 2 and which in the mounted position abuts snugly on such inner surface of the drawer side wall 2. During premounting, the front wall 1 is inserted into a vertical recess or groove 17 of the fitting member 6a and screwed therein by means of screws 18**.

The fitting member 6a has at its front a cover plate 27 which forms in this arrangement an integral part therewith. Cover plate 27 covers, in the mounted position, the front side 25 of the associated drawer side wall 2 and hence protects the connecting device 6b by preventing the entry of dust and further improves the visual appearance of the drawer. The stops 26 are formed at the rear side of cover plate 27. The front of the cover plate 27 also covers a small part of the front wall 1.

The upper side of the drawer may include a rail 19 which is shown in broken lines and is held by means of rail supports including front rail supports 20 that may be formed with or fastened to the fitting members 6a and rear rail supports 21 that may, for example, be formed with or fastened to upwardly extended rear wall 10.

When using the connecting fitting 6a, 6b according to the present invention, an internal drawer can be provided with exactly the same drawer side walls as the other type of drawer in which the front wall is fitted to the front sides of the drawer side walls and extends in many cases laterally beyond the breadth of the drawer. Also, this structure of the drawer (perhaps with the exception of a shorter bottom), as well as the holes which are predrilled in the body for the body rails 5 associated with the drawer side walls, may be the same as provided in such afore-mentioned other drawer type.

Figure 5:
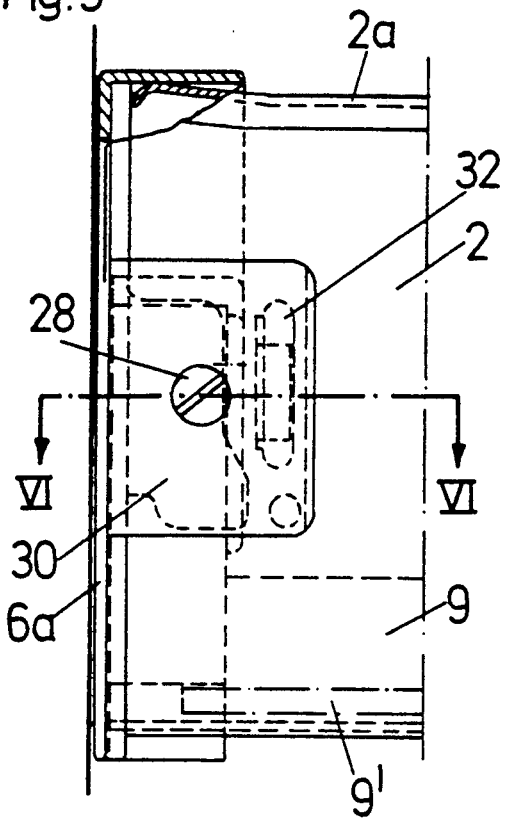
FIG. 5 is a side view of the front region of a drawer with a drawer side wall having a Z-shaped profile.
Figure 6:
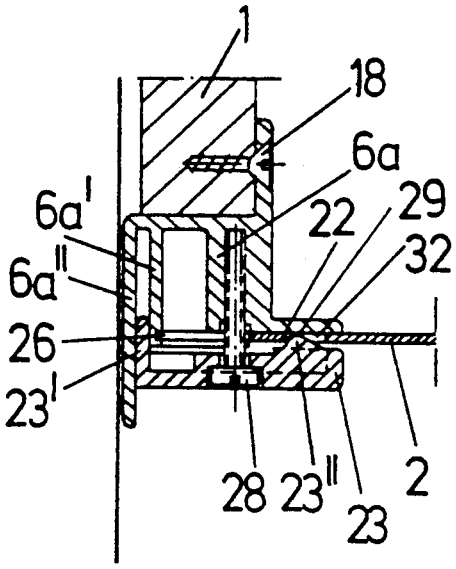
FIG. 6 is a sectional view along line VI—VI of FIG. 5.
Figure 7:
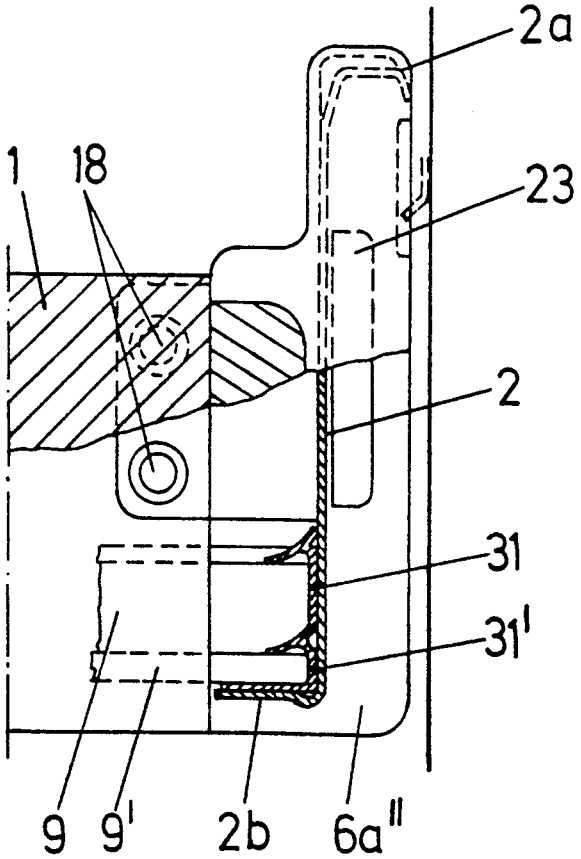
FIG. 7 is a front view of a part of the embodiment shown in FIGS. 5 and 6.

The embodiment shown in FIGS. 5 to 7 differs from the embodiment shown in FIGS. 2 to 4 essentially in that the embodiment of FIGS. 5–7 includes a steel drawer side wall 2 having a Z-shaped profile instead of the hollow profiled-aluminum drawer side wall and a differently formed connecting fitting. The same numerals as used in FIGS. 1 to 4 denote identical or equivalent parts.

A fitting member 6a has a holding surface 22 which extends transversely to the front wall 1 and which abuts on the inner side of a vertical flange of the steel drawer side wall 2. A clamping plate 23 is loosely connected with the fitting member 6a by means of a screw 28 to prevent loss thereof. For mounting the front wall 1, the fitting member 6a, which is premounted to front wall 1 by means of screws 18, together with the clamping plate 23 which is loosely connected thereto, is pushed from the front side in the longitudinal direction of the drawer side wall onto the vertical flange of the steel drawer side wall 2, with the screw 28 extending through a recess 30 which is formed in the vertical flange of the drawer side wall and which is open at the front. After this operation the screw 28 is fastened. A nose 23'' formed at the clamping plate 23 enters into an opening 32 in the drawer side wall 2 and abuts by means of an inclined surface 29 on a front or abutment surface edge of the opening 32. Tightening of screw 28 creates tensile force, acting in the longitudinal direction of the drawer side wall, on the clamping plate 23 and is transferred by means of the screw 28 and an L-shaped angular leg 23' to a portion 6a' of the fitting member 6a. Portion 6a' has at its end a stop 26 which thus is pulled towards the front side of the side wall 2, thus guaranteeing a firm connection between the side wall 2 and fitting member 6a and thereby between the side wall 2 and the front wall 1, In this illustrated embodiment, the plate-shaped cover element 6a'' is provided at the front of member 6a and covers the front of the drawer side wall 2 together with the connecting mechanism. The fitting member 6a and the clamping plate 23 are advantageously made of plastics material or metal, such as die-cast zinc.

FIG. 7 further shows two different bottom supports 31 and 31', 31 being suitable for a thicker bottom 9 and 31' for a thinner bottom 9' (e.g. a hard board bottom).

Figure 8:
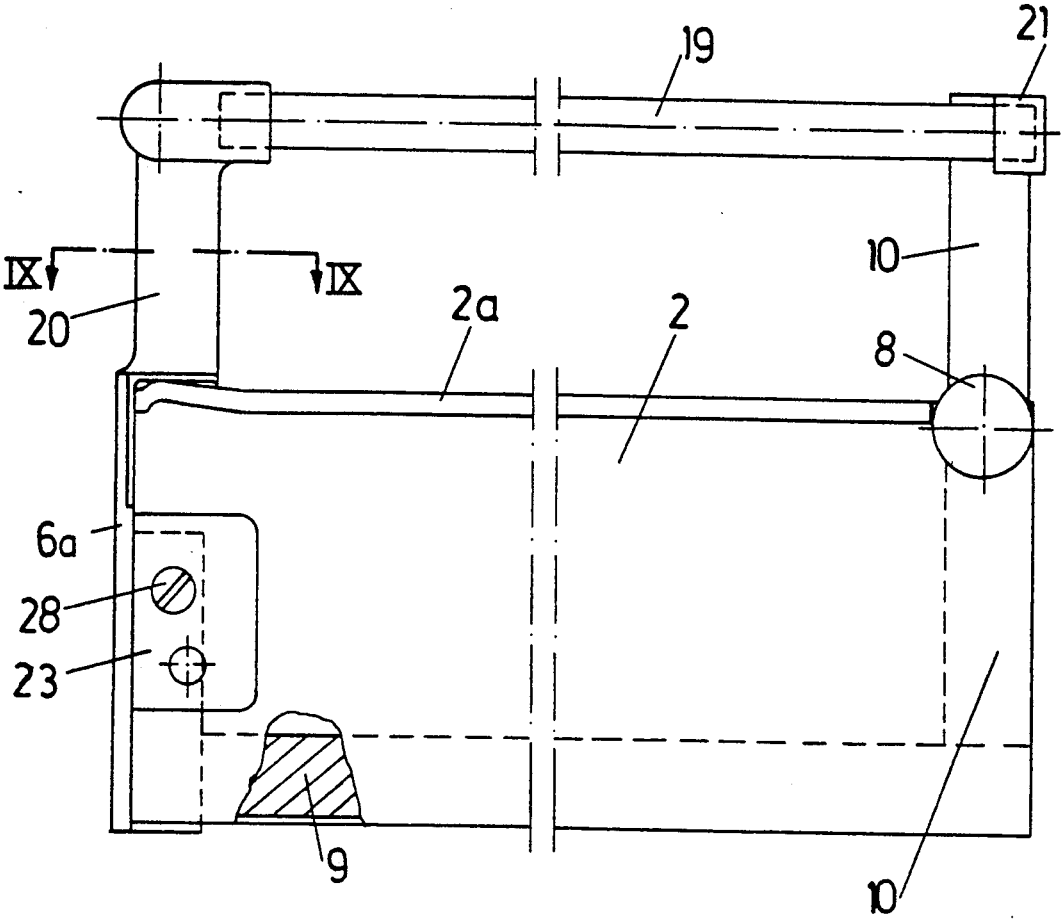
FIG. 8 is a side view of a further embodiment of the drawer according to the invention with a steel side wall having a Z-shaped profile.
Figure 9:
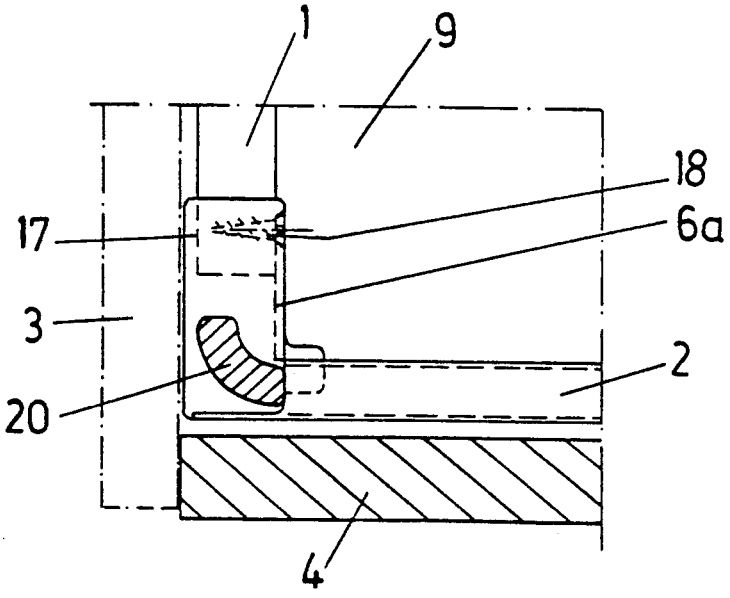
FIG. 9 is a sectional view along XI—XI of FIG. 8.
Figure 10:
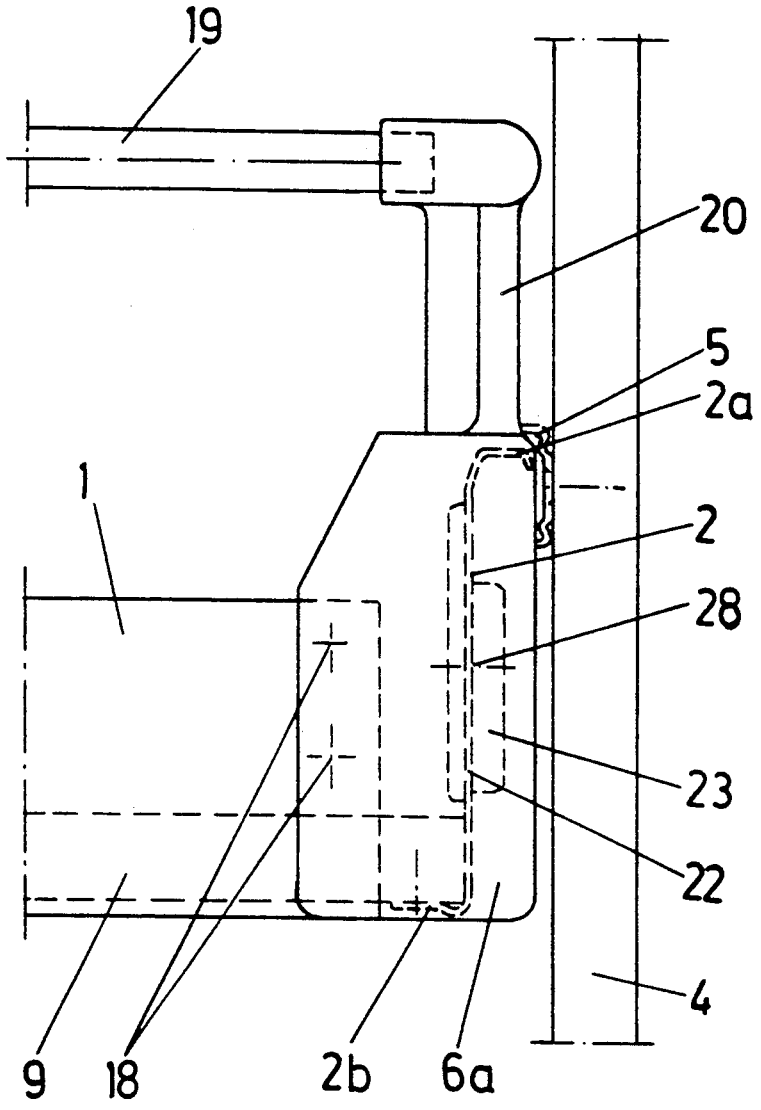
FIG. 10 is a front view of a part of the embodiment shown in FIGS. 8 and 9.

The embodiment illustrated in FIGS. 8 to 10 is basically very similar to the embodiment shown in FIGS. 5 to 7. FIGS. 8 to 10 do not show in detail the constructional details of the connection between the front wall and the drawer side wall. Particularly clearly shown are the position of the drawer in the body 4 behind the front door 3, and the arrangement of the rail 19 as well as the covering of the front side of the drawer side wall 2 by a plate-shaped fitting member 6a.

Figure 11:
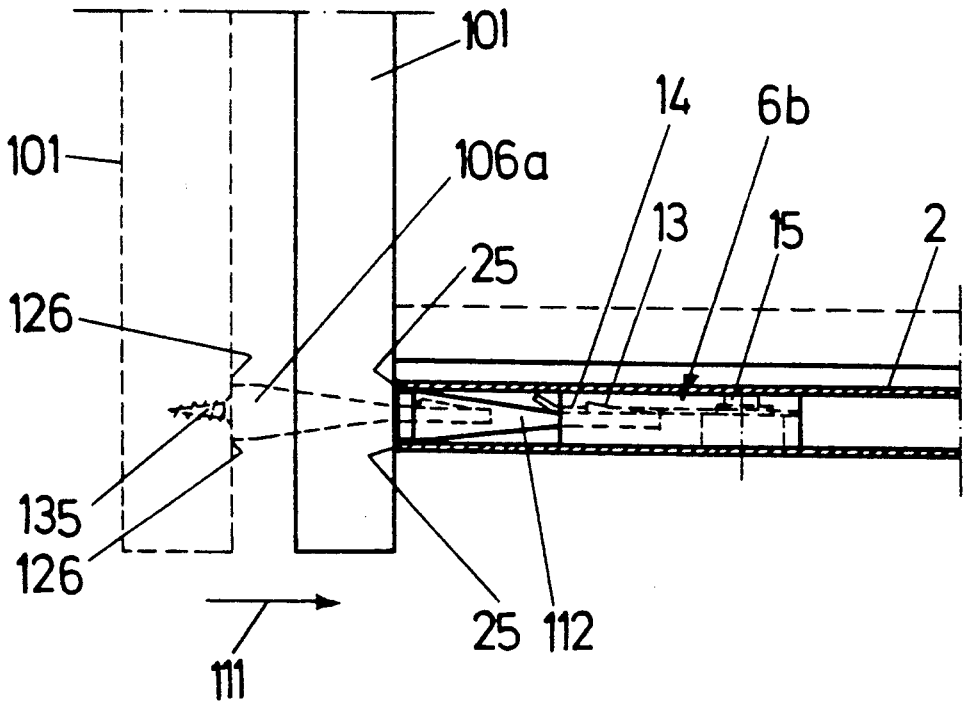
FIG. 11 is a view similar to FIG. 3 but with a front plate and an associated fitting member fitted onto the front side of the drawer side wall.

It is a particular advantage of the fitting member 6a that it can be used for the same drawer side walls 2 in an arrangement wherein the front plate itself is mounted to abut or extend over the fronts of the side walls. This can be seen by comparing FIG. 3 with FIG. 11, in both of which cases the same drawer side wall 2 and connecting device 6b (spring tongue 14, clamping eccentric 15) can be used, i.e. in FIG. 3 for an internal drawer with the fitting member 6a according to the invention, and in FIG. 11 for a front plate 101 which is mounted to the front side and on which a fitting member 106a is premounted by means of screws 135. Fitting member 106a includes a projection 112 with a laterally extending nose or protrusion 13 and is insertable in the direction of arrow 111 from the front into the drawer side wall 2. The spring tongue 14 engages behind the nose 13 and pulls the fitting member 6a into the drawer side wall 2 by actuating the clamping eccentric 15 until stops 126 formed at the rear side of the front plate 101 abut snugly on the front sides 25 of the drawer side wall 2.

According to a preferred embodiment of the invention, there is provided a set of two types of fitting members to be premounted at a front wall 1 or front plate 101 of a drawer and suitable for being connected with the same drawer side walls 2, such set including:

a) at least one pair of first fitting members 106a for connecting a front plate 101 to front sides 25 of the drawer side walls 2 (FIG. 11), and b) at least one pair of second fitting members 6a for connecting a front wall 1 which lies in the mounted position between the drawer side walls 2 to the drawer side walls 2, such second fitting members 6a each having at least one stop 26 which lies substantially laterally beside the front wall 1 and is pullable towards the front side 25 of the respective drawer side wall 2 for firmly connecting the front wall 1 with the drawer side walls 2 (FIG. 3).

Each pair thus includes fitting members 6a or 106a which are to be mounted to the left side and to the right side of the front wall 1 or front plate 101, respectively. The first and second fitting members fit with the same drawer side wall so that there no longer need be any difference in the side wall structure either for an internal drawer or for an external drawer with a front plate fitted to the front side thereof. Known fitting members can equally be sued as the first fitting members.

The drawer according to the invention obviously also may be used as a drawer which is not a simple pull-out guide and hence is not covered by an additional cover plate. Finally, the drawer according to the invention is not limited to the illustrated simple pull-out guides. Other pull-out guides obviously also are possible wherein, e.g., a runner roller moving in a side wall rail is pivotally mounted on an extractable center rail.

What is claimed is:

1. In a drawer including two parallel side walls and a front wall, each said side wall including a front end, said front wall having opposite lateral ends and being located in a position extending between said side walls and substantially rearwardly of said front ends of said side walls, and connecting fittings for releasably connecting each said lateral end of said front wall to the respective said side wall, the improvement wherein each said connecting fitting comprises:

a fitting member connected to the respective said lateral end of said front wall, said fitting member having at least one stop located substantially laterally of said respective lateral end of said front wall; and pulling means, engageable with said fitting member and operable between the respective said side wall and said fitting member, for exerting a pulling force on said fitting member in a direction longitudinally rearwardly of said respective side wall, and thereby for urging said stop toward and into firm abutment against said front end of said respective side wall, thus obtaining a firm connection between said respective side wall and said front wall.

2. The improvement claimed in claim 1, wherein said side walls are formed of metal.

3. The improvement claimed in claim 1, wherein said stop is located at a position substantially aligned laterally of the front face of said front wall.

4. The improvement claimed in claim 1, wherein said fitting member is movable in said direction longitudinally rearwardly of said respective side wall during an initial connection of said fitting member to said respective side wall and before operation of said pulling means to generate said pulling force.

5. The improvement claimed in claim 4, wherein said fitting members on both said lateral ends of said front wall are movable simultaneously in respective said directions.

6. The improvement claimed in claim 1, wherein, prior to said pulling means exerting said pulling force, the position of said fitting member relative to said respective side wall is adjustable.

7. The improvement claimed in claim 1, wherein said fitting member includes a projection extending in a direction substantially at a right angle to said front wall, said projection having extending laterally therefrom at least one protrusion.

8. The improvement claimed in claim 7, wherein said pulling means includes a plate spring connected to said respective side wall for movement relative thereto longitudinally thereof, said plate spring including means for engaging said protrusion upon movement of said projection in said longitudinally rearwardly direction toward said respective side wall.

9. The improvement claimed in claim 8, wherein said pulling means further includes means, mounted on said respective side wall and connected to said plate spring, for selectively moving said plate spring in said longitudinally rearwardly direction.

10. The improvement claimed in claim 9, wherein said moving means comprises an eccentric rotatably mounted on said respective side wall.

11. The improvement claimed in claim 8, wherein said plate spring has an opening therein, such that said protrusion snaps into said opening upon said movement of said projection, and said engaging means comprises a portion of said plate spring defining a forward end of said opening.

12. The improvement claimed in claim 8, wherein said respective side wall is hollow, said plate spring is located within said respective side wall, and said projection is insertable into said side wall from said front end thereof.

13. The improvement claimed in claim 1, wherein said fitting member has a vertical holding surface extending substantially at a right angle to said front wall and abutting a first side of said respective side wall, and said pulling means includes a clamping plate on a second side of said respective side wall and bolt means extending through said respective side wall and mounting said fitting member and said clamping plate thereto.

14. The improvement claimed in claim 13, wherein said clamping plate has a surface inclined to said longitudinally rearwardly direction and in contact with an abutment surface of said respective side wall, such that tightening of said bolt means moves said clamping plate toward said respective side wall, thus causing said inclined surface to be moved over said abutment surface and imparting to said clamping plate movement in said longitudinally rearwardly direction.

15. The improvement claimed in claim 14, wherein said clamping plate has a portion engaging said fitting member and thereby transferring said longitudinally rearwardly movement to said fitting member.

16. The improvement claimed in claim 15, wherein said engaging portion of said clamping plate comprises a leg extending in a direction transverse to said respective side wall and engaging forwardly a part of said fitting member having said stop, such that upon movement of said clamping plate in said longitudinally rearwardly direction said leg pulls said part of said fitting member toward said front end of said respective side wall.

17. The improvement claimed in claim 13, wherein said bolt means loosely mounts said clamping plate on said fitting member when said front plate is not connected to said respective side wall.

18. The improvement claimed in claim 1, wherein said fitting member has therein a recess extending transverse to the longitudinal dimension of said respective side wall and into which extends said respective lateral end of said front wall.

19. The improvement claimed in claim 18, further comprising means for fixing said respective lateral end of said front wall in said recess.

20. The improvement claimed in claim 18, wherein said recess comprises a vertical groove.

21. The improvement claimed in claim 1, wherein said fitting member has an abutment surface firmly abutting an inner side surface of said respective drawer side wall.

22. The improvement claimed in claim 1, wherein said fitting member covers said front end of said respective side wall.

23. The improvement claimed in claim 1, wherein said fitting plate includes a cover member covering said front end of said respective front wall.

24. The improvement claimed in claim 23, wherein said cover plate also covers a portion of the front of said front wall.

25. The improvement claimed in claim 23, wherein said stop is located at a rear portion of said cover plate.

26. The improvement claimed in claim 1, wherein said fitting member includes an upwardly extending rail support.

27. A connecting fitting for use in releasably connecting a lateral end of a front wall of a drawer to a side wall of the drawer at a position such that the lateral end of the front wall is positioned laterally of and substantially rearwardly of a front end of the side wall, said connecting fitting comprising:

a fitting member to be connected to the lateral end of the front wall, said fitting member having at least one laterally extending stop to be located at a cooperative position laterally of the lateral end of the front wall and forwardly of the front end of the side wall, said stop defining means to be urged into firm abutment against the front end of the side wall and thereby for obtaining a firm connection between the side and front walls.

28. A fitting as claimed in claim 27, further comprising pulling means, engageable with said fitting member and operable between the side wall and said fitting member, for exerting a pulling force on said fitting member in a direction longitudinally rearwardly of the side wall, and thereby for urging said stop toward and into said firm abutment.

29. A fitting as claimed in claim 28, wherein said stop extends from said fitting member at a position substantially to be aligned laterally of a front face of the front wall.

30. A fitting as claimed in claim 28, wherein said fitting member is movable in said direction longitudinally rearwardly of the side wall during an initial connection of said fitting member to the side wall and before operation of said pulling means to generate said pulling force.

31. A fitting as claimed in claim 28, wherein, prior to said pulling means exerting said pulling force, the position of said fitting member relative to the side wall is adjustable.

32. A fitting as claimed in claim 28, wherein said fitting member includes a projection extending in a direction substantially to be at a right angle to the front wall, said projection having extending laterally therefrom at least one protrusion.

33. A fitting as claimed in claim 32, wherein said pulling means includes a plate spring to be connected to the side wall for movement relative thereto longitudinally thereof, said plate spring including means for engaging said protrusion upon movement of said projection in said longitudinally rearwardly direction toward the side wall.

34. A fitting as claimed in claim 33, wherein said pulling means further includes means, to be mounted on the side wall and connected to said plate spring, for selectively moving said plate spring in said longitudinally rearwardly direction.

35. A fitting as claimed in claim 34, wherein said moving means comprises an eccentric to be rotatably mounted on the side wall.

36. A fitting as claimed in claim 33, wherein said plate spring has an opening therein, such that said protrusion snaps into said opening upon said movement of said projection, and said engaging means comprises a portion of said plate spring defining a forward end of said opening.

37. A fitting as claimed in claim 28, wherein said fitting member has a vertical holding surface to extend substantially at a right angle to the front wall and to abut a first side of the side wall, and said pulling means includes a clamping plate to be on a second side of the side wall and bolt means to be extended through the side wall and mounting said fitting member and said clamping plate thereto.

38. A fitting as claimed in claim 37, wherein said clamping plate has a surface inclined to said longitudinally rearwardly direction and to be contacted with an abutment surface of the side wall, such that tightening of said bolt means moves said clamping plate toward the side wall, thus causing said inclined surface to be moved over the abutment surface and imparting to said clamping plate movement in said longitudinally rearwardly direction.

39. A fitting as claimed in claim 38, wherein said clamping plate has a portion engaging said fitting member and thereby transferring said longitudinally rearwardly movement to said fitting member.

40. A fitting as claimed in claim 39, wherein said engaging portion of said clamping plate comprises a leg extending in a direction to be transverse to the side wall and engaging forwardly a part of said fitting member having said stop, such that upon movement of said clamping plate in said longitudinally rearwardly direction said leg pulls said part of said fitting member toward the front end of the side wall.

41. A fitting as claimed in claim 37, wherein said bolt means loosely mounts said clamping plate on said fitting member when the front plate is not connected to the side wall.

42. A fitting as claimed in claim 28, wherein said fitting member has therein a recess extending in a direction to be transverse to the longitudinal dimension of the side wall and into which is to extend the lateral end of the front wall.

43. A fitting as claimed in claim 42, further comprising means for fixing the lateral end of the front wall in said recess.

44. A fitting as claimed in claim 42, wherein said recess comprises a vertical groove.

45. A fitting as claimed in claim 28, wherein said fitting member has an abutment surface to be firmly abutted with an inner side surface of the side wall.

46. A fitting as claimed in claim 28, wherein said fitting member includes means for covering the front end of the side wall.

47. A fitting as claimed in claim 28, wherein said fitting member includes a cover plate to cover the front end of the front wall.

48. A fitting as claimed in claim 47, wherein said cover plate also includes a portion to cover a portion of the front of the front wall.

49. A fitting as claimed in claim 47, wherein said stop is located at a rear portion of said cover plate.

50. A fitting as claimed in claim 28, wherein said fitting member includes an upwardly extending rail support.

* * * * *